US005280302A

United States Patent [19]

Rubin et al.

[11] Patent Number: 5,280,302

[45] Date of Patent: Jan. 18, 1994

[54] RECORDING APPARATUS WITH MAGNETIC BRUSH REMOVAL OF NON-TACKED TONER

[75] Inventors: Bruce J. Rubin; Peter G. Evans, both of Rochester; Dennis R. Kamp, Spencerport; Kevin E. Yousey, Brockport; James R. Flick, Rochester, all of N.Y.

[73] Assignee: Eastman Kodak Company, Rochester, N.Y.

[21] Appl. No.: 894,675

[22] Filed: Jun. 5, 1992

[51] Int. Cl.[5] ..... B41M 5/26

[52] U.S. Cl. ..... 346/762; 355/305

[58] Field of Search ..... 346/76 R, 76 L, 1.1; 355/305, 306

[56] References Cited

U.S. PATENT DOCUMENTS

| | | | |
|---|---|---|---|
| 4,482,244 | 11/1984 | Yamazaki et al. | 355/305 |
| 4,483,611 | 11/1984 | Matsuura et al. | 355/302 |
| 4,494,863 | 1/1985 | Laing | 355/302 |
| 4,547,063 | 10/1985 | Stange | 355/305 |
| 4,571,071 | 2/1986 | Bothner | 355/298 |

FOREIGN PATENT DOCUMENTS

| | | | |
|---|---|---|---|
| 62-227692 | 10/1987 | Japan | 346/76 L |

*Primary Examiner*—Joan H. Pendegrass
*Attorney, Agent, or Firm*—Leonard W. Treash

[57] ABSTRACT

The present invention is used in an image-recording apparatus wherein a substantially uniform layer of triboelectrically charged thermoplastic toner particles is deposited onto an imaging member. The toner particles are imagewise heated such that the heated toner particles are thermally tacked to the imaging member. The imaging member is then contacted with a mass of magnetic carrier particles to attract nonheated toner particles to the carrier particles, thereby removing nonheated toner particles from the imaging member and ladening the carrier particles with the removed toner particles. In accordance with the invention, upon using the carrier particles to attract and remove toner from the imaging member, the toner-laden carrier particles are mixed with a supply of carrier particles in which the average number of toner particles per carrier particle is lower than that of said toner-laden carrier particles. This produces a mixture of carrier particles in which the average amount of toner attracted to each carrier particle is substantially lower than that of the toner-laden carrier particles. This mixture is then subjected to a detoning step in which essentially all of the toner on each carrier particle is removed prior to the carrier particles being contacted to the imaging member again.

3 Claims, 2 Drawing Sheets

RECORDING APPARATUS WITH MAGNETIC BRUSH REMOVAL OF NON-TACKED TONER

CROSS-REFERENCE TO RELATED APPLICATION

This application is related to the commonly assigned, co-pending U.S. Pat. No. 5,138,388, issued Aug. 11, 1992, in the name of Kamp et al. and entitled "HIGH SPEED, LOW POWER PRINTER".

BACKGROUND OF THE INVENTION

1. Technical Field of the Invention

The present invention relates generally to the field of image recording apparatus and, more specifically, to an improved method and apparatus by which toner particles are removed from an imaging member.

2. Background Art

The cross-referenced application discloses a method and apparatus for producing images on an imaging member. Such apparatus utilizes a moving imaging member onto which a substantially uniform layer of thermoplastic toner particles is deposited. The toner particles are imagewise heated by a scanning, intensity-modulated laser beam which lightly tacks the heated toner particles to the imaging member. Those toner particles which are not tacked to the imaging member (i.e. the nonheated toner particles) are removed from the imaging member by an electrically biased magnetic brush utilizing magnetic carrier particles. The remaining toner defines an image on the imaging member.

The toner-removing magnetic brush includes a nonmagnetic shell having a magnetic core disposed therein. The core is composed of a series of magnetic strips of alternating polarity. Relative movement is provided between the shell and core, and an electrical bias is applied to the shell. Magnetic carrier particles are applied to the shell and remain there due to their attraction to the magnetic core. When the imaging member is contacted by the carrier particles, the nonheated toner particles are attracted to the carrier particles and are thereby removed from the imaging member.

In the above imaging process, it will be appreciated that a large quantity of toner particles must be removed from the imaging member in a short period of time in order to efficiently create images. In fact, more toner is sometimes removed from the imaging member than is left behind to form the image. To prevent the toner-removing magnetic brush from quickly loading-up with toner particles and thereby rendering the brush ineffective as a toner removing device, a biased roller (referred to as a "detoning" roller) can be arranged to contact the brush "nap" downstream of the nip between the brush and imaging member. Such a roller is electrically biased to strip toner from the carrier particles and thereby allow the denuded carrier particles to be used again to remove toner from the imaging member. The toner on the detone roller is removed by, for example, a skive and is either recycled or discarded. While such a toner removing system can operate effectively at slow speeds, it does not lend itself to high speed imaging. This is because such large amounts of toner particles become attached to the carrier particles that it is very difficult for the detoning roller to remove all the toner from the carrier when images are being created at high speed.

SUMMARY OF THE INVENTION

In view of the foregoing discussion, an object of this invention is to provide a method and apparatus for enhancing the effectiveness of a toner removal system of the type described.

The present invention is used in an image-recording apparatus wherein a substantially uniform layer of triboelectrically charged thermoplastic toner particles is deposited onto an imaging member. The toner particles are imagewise heated such that the heated toner particles are thermally tacked to the imaging member. The imaging member is then contacted with a mass of magnetic carrier particles, having little or no attached toner particles, to attract nonheated toner particles to the carrier particles, thereby removing nonheated toner particles from the imaging member and ladening the carrier particles with the removed toner particles. After using the carrier particles to attract and remove toner from the imaging member, the toner-laden carrier particles are mixed with a supply of carrier particles in which the average number of toner particles per carrier particle is lower than that of said toner-laden carrier particles. This produces a dilute mixture of carrier particles in which the average amount of toner attracted to each carrier particle is substantially lower than that of the toner-laden carrier particles. In accordance with the invention, this mixture is then subjected to a detoning step in which substantially all of the toner on each carrier particle is removed prior to the carrier particles being contacted to the imaging member again.

Other objects and advantages will become more apparent to those skilled in the art from the ensuing detailed description of the preferred embodiments.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
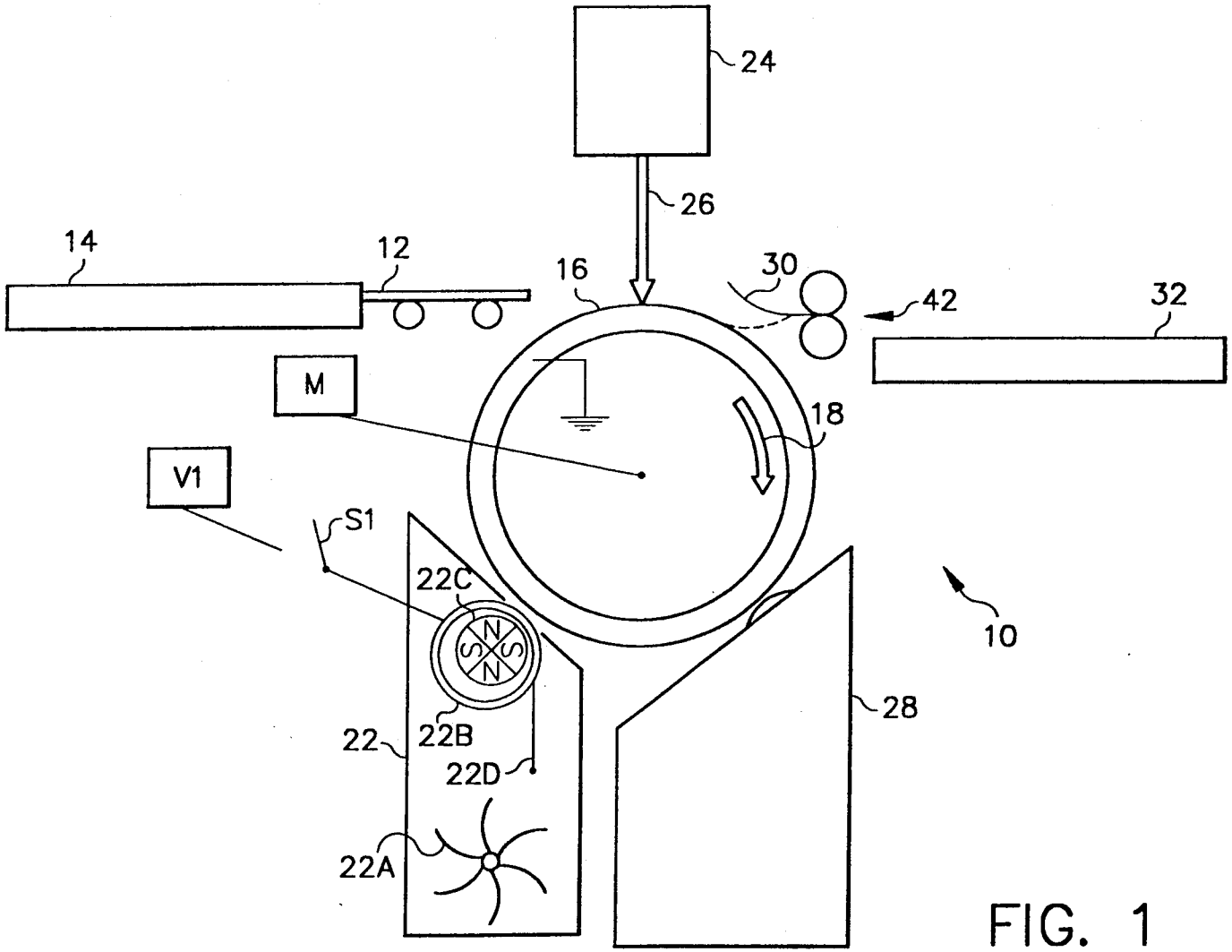
FIG. 1 is a side schematic illustration of an image reproduction system.

Turning now to FIG. 1, an image-recording apparatus, designated generally by the reference numeral 10, is shown. An imaging member 12 is fed from an imaging member supply 14 onto a process drum 16. Drum 16 includes an outer conductive layer which is connected to ground. The imaging member can be made of a variety of materials such as (1) a plain piece of paper, (2) a metal plate or (3) a support layer, such as Kodak Estar film base, over which lies a thin, essentially transparent conductive layer, such as cuprous iodide, and a thermoplastic outer layer composed of a material such as a poly-acrylic ester. The paper and metal plate imaging members can optionally include a thermoplastic outer layer. In the following description (3) above will be used.

Imaging member 12 is held to the process drum by conventional means, such as by the use of a vacuum applied through vacuum holes(not shown) in the surface of process drum 16. The process drum is rotated by a motor M in the direction of an arrow 18 at a surface speed of about 10 cm/s.

An electrically biased magnetic brush 22 contains a mixture of thermoplastic toner particles and magnetic carrier particles. The toner particles include a pigment, such as carbon, in a thermoplastic binder. The toner and carrier particles are mixed by a rotating auger 22A. This mixing action triboelectrically charges the toner and carrier particles to opposite polarities, causing the toner and carrier to be attracted to each other. The developer mixture is deposited on a shell 22B by the auger and remains there due to the carrier particles' attraction to a magnetic core 22C located within shell 22B. The shell is made of a nonmagnetic, electrically conductive material while the core is composed of a series of strip magnets which alternate in polarity about the circumference of the core. Relative movement is provided between the core and shell by rotating the core and/or shell.

As the lead edge of imaging member 12 reaches the interface between shell 22B and drum 16, a switch S1 is closed. The closing of switch S1 connects a voltage supply V1 to shell 22B, causing an electrical bias of several hundred volts, and of the same polarity as the charge on the toner particles, to be applied to shell 22B. This causes an electric field to be established between the shell and the grounded conductive layer of drum 16. If the imaging member includes a conductive layer, this conductive layer is grounded, preferably through the grounded conductive layer of drum 16, and the electric field is established between shell 22B and the grounded conductive layer in imaging member 12. Toner particles leave the carrier particles under the influence of this electric field and are deposited in a substantially uniform layer on the outer layer of imaging member 12. The oppositely charged carrier particles remain on shell 22B due to their magnetic attraction to core 22C and to their electrostatic attraction to shell 22B. A skive 22D removes the toner particle depleted developer mixture from shell 22B. As the trail edge of imaging member 12 leaves the interface between the shell and drum 16, the electrical bias to shell 22B is turned off by opening switch S1, discontinuing the deposition of toner particles. The rotation of auger 22A is discontinued.

Process drum 16 is now accelerated to a higher surface speed such as 400 cm/s. A laser diode 24 emits a laser beam 26 which is intensity-modulated according to image information to be recorded. To imagewise heat the toner particle layer, laser diode 24 is moved slowly from one edge of process drum 16 to the other edge. Thus, as the laser diode moves, image information is recorded in scan lines essentially perpendicular to the axis of rotation of the drum.

Laser beam 26 is focused on either the toner particle layer or imaging member 12. The duration of laser exposure for each selected pixel is only long enough to generate enough heat to slightly melt selected toner particles. For example, at a drum surface speed of 400 cm/s a 20 micron diameter laser spot of 200 mW can be used. This causes only the heated toner particles to be thermally tacked to the imaging member. The laser exposure will also soften the thermoplastic outer layer. The softened thermoplastic assists in tacking the selected toner particles to imaging member 12. The selected toner particles need only be lightly tacked because a second magnetic brush, described below, gently removes nonselected toner particles from the imaging member without disturbing the lightly tacked selected toner particles. Because the selected toner particles need be only lightly tacked to imaging member 12 rather than completely fused, laser heating can be accomplished much faster. Images can be created at a higher rate.

Figure 2:
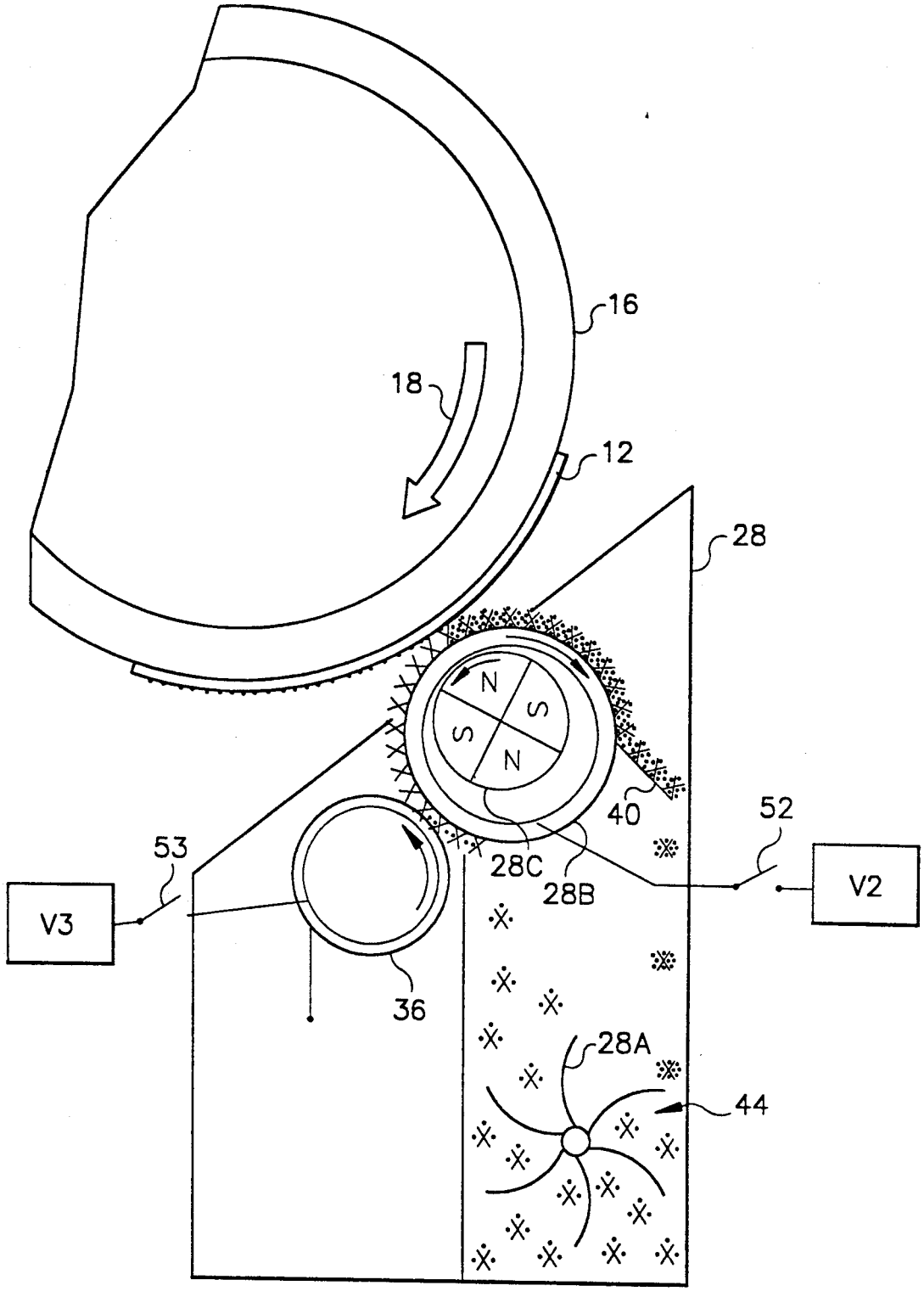
FIG. 2 is a side schematic illustration of a magnetic brush embodying the present invention.

After laser heating is complete, process drum 16 is decelerated to a surface speed of about 10 cm/s. With reference to FIG. 2, imaging member 12 is advanced by drum 16 towards a magnetic brush 28 which contains a supply of magnetic carrier particles. Preferably, these particles are hard magnetic carrier particles which will flip-flop when exposed to alternating polarity magnetic fields. Typically, these hard particles have a coercivity in excess of 100 oersteds. Examples of materials from which such hard magnetic carrier particles can be made are barium ferrite and strontium ferrite.

A rotating auger 28A deposits a layer of hard magnetic carrier particles on a shell 28B. The carrier particles remain on the shell because of their magnetic attraction to a core 28C. Shell 28B and core 28C operate in a similar manner to shell 22B and core 22C. The relative movement between shell 28B and core 28C exposes the hard carrier particles to alternating polarity magnetic fields, causing the mass of carrier particles to tumble about the surface of the shell.

As the lead edge of imaging member 12 approaches the interface between shell 28B and drum 16, an electrical bias of preferably between about 5 and 200 volts and of opposite polarity to the charge on the toner particles is applied to the shell by closing a switch S2 attached to an adjustable voltage supply V2. The imaging member is contacted by the carrier particles whose tumbling action removes the non-heated toner particles from the imaging member while not disturbing the heated (and now thermally tackified) toner particles. The carrier and non-heated toner particles triboelectrically charge to opposite polarities due to their interaction, causing them to be electrostatically attracted to each other. As a result of this interaction, the carrier particles become laden with toner particles.

A skive 40 strips the toner-laden carrier particles from shell 28B. The toner laden carrier particles fall into a sump 44 where they are mixed with a supply of carrier particles in which the average number of toner particles per carrier particle is lower than that of the toner-laden carrier particles. Preferably, the carrier particles in the sump have little or no toner particles attached. This mixing action produces a carrier particle mixture in which the average number of toner particles per carrier particle is intermediate that of the toner-laden carrier particles and the carrier particles of said supply. Auger 28A again applies the mixture of carrier particles, bearing a much lower amount of toner in comparison to the toner-laden carrier particles stripped from shell 28B, onto shell 28B.

Substantially all of the toner particles are removed from the carrier particles on shell 28B by a biasable, detone roller 36. A voltage is placed on the roller by closing a switch S3 attached to a voltage supply V3. This voltage is selected such that an electric field is established between shell 28B and detone roller 36 which will cause toner particles on shell 28B to transfer to roller 36. Toner particles are removed from the detone roller by a stripping blade 38. The carrier particles remaining on shell 28B, now essentially free of toner particles, may be used again to contact imaging member 12 and remove more nonheated toner particles from the imaging member.

By locating the detone roller as shown in FIG. 2, the detone roller need remove far less toner from the carrier particles than if the roller was located as in the prior art (i.e. at a point about the shell just after where the toner particles have been transferred to the shell from the imaging member). Detone roller 36 is able to remove substantially all toner particles from the carrier particles of the dilute mixture without becoming overwhelmed with the large amount of toner being removed from the imaging member. The goal is to remove most of the toner particles from the carrier particles prior to using the carrier particles to clean imaging member 12.

In another embodiment of the invention the "detoning" process is continued after imaging member 12 has been completely rotated past magnetic brush 28. The purpose of continuing the detoning is to remove essentially all of any remaining toner particles which still remain attached to the carrier particles. This may be necessary if a very large amount of nonheated toner particles were removed from imaging member 12. In this embodiment the location of detoning roller 36 about shell 28B is not critical (i.e. roller 36 can be located as in the prior art). This is because the goal is to remove most of the toner particles from the carrier particles prior to cleaning of the next image.

The invention has been described in detail with particular reference to preferred embodiments thereof, but it will be understood that variations and modifications can be effected within the spirit and scope of the invention.

What is claimed is:

1. An apparatus for recording an image on an imaging member, said apparatus comprising:

means for depositing a substantially uniform layer of thermoplastic toner particles onto said imaging member;

means for imagewise heating the layer of toner particles such that only the heated toner particles are thermally tacked to said imaging member; and means for contacting said imaging member with a tumbling mass of magnetic carrier particles to attract nonheated toner particles to said carrier particles, thereby removing nonheated toner particles from said imaging member and ladening said carrier particles with said nonheated toner particles;

mean including an auger for mixing the toner-laden carrier particles with carrier particles bearing fewer toner particles than the toner-laden carrier particles such that the average concentration of toner particles on the toner-laden carrier particles is reduced; and means for removing toner particles from the mixture of carrier particles and toner particles.

2. The apparatus of claim 1 wherein said imaging member has an outer layer on which said toner particles are deposited, said outer layer including a thermoplastic material.

3. The apparatus of claim 1 wherein said removing means continues to remove toner particles from said mixture of carrier particles after essentially all of said nonheated toner particles have been removed from said imaging member.

* * * * *